United States Patent [19]

Heiney

[11] Patent Number: 5,021,004

[45] Date of Patent: Jun. 4, 1991

[54] SECONDARY LATCH FOR PIN CONNECTOR

[75] Inventor: Francis M. Heiney, Elizabethtown, Pa.

[73] Assignee: AMP Incorporated, Harrisburg, Pa.

[21] Appl. No.: 558,136

[22] Filed: Jul. 26, 1990

[51] Int. Cl.[5] ..... H01R 4/24

[52] U.S. Cl. ..... 439/317

[58] Field of Search ..... 439/389–426

[56] References Cited

U.S. PATENT DOCUMENTS

| | | | |
|---|---|---|---|
| 3,252,126 | 5/1966 | Brown | 439/417 |
| 4,070,081 | 1/1978 | Takahashi | 339/91 R |
| 4,105,275 | 8/1978 | Dixon et al. | 339/91 R |
| 4,152,038 | 5/1979 | Inouye | 339/75 M |
| 4,178,051 | 12/1979 | Kocher et al. | 339/45 M |
| 4,241,966 | 12/1980 | Gomez | 339/45 M |
| 4,410,222 | 10/1983 | Enomoto et al. | 339/17 F |
| 4,471,101 | 5/1984 | Gugliotti | 339/45 M |
| 4,579,408 | 4/1986 | Sasaki | 339/45 M |
| 4,640,565 | 2/1987 | Hasircogler | 339/45 M |
| 4,648,009 | 3/1987 | Beun et al. | 361/399 |
| 4,741,707 | 5/1988 | Mondor, III | 439/417 |
| 4,753,608 | 6/1988 | Yamaguchi | 439/417 |
| 4,761,141 | 8/1988 | Hawk et al. | 439/153 |

FOREIGN PATENT DOCUMENTS

| | | |
|---|---|---|
| 1596006 | 8/1981 | United Kingdom . |
| 2082401 | 3/1982 | United Kingdom . |
| 2166300 | 4/1986 | United Kingdom . |

*Primary Examiner*—Joseph H. McGlynn
*Attorney, Agent, or Firm*—David L. Smith

[57] ABSTRACT

There is disclosed a pin connector (20) for insulation displacement termination of conductors of a multiple conductor cable (156) has a housing (22) having insulation displacement contacts (26) secured therein. Each of the insulation displacement contacts (26) has an insulation displacement portion extending beyond a cable receiving face (48) for terminating to conductors of a multiconductor cable. A termination cover (28) securable to the housing (22) is adapted to be pressed toward the cable receiving face (48) to terminate conductors of the cable (156) to respective contacts (26). The termination cover (28) has a pivotally mounted latch/eject lever (30) secured thereto for latchingly securing a mating connector to the pin connector. The housing has extensions (250) with protrusions (252) receivable in pivotal mounting apertures (120) to secure the termination cover (28) to the housing (22) at the termination position.

20 Claims, 5 Drawing Sheets

SECONDARY LATCH FOR PIN CONNECTOR

CROSS REFERENCE TO RELATED APPLICATIONS

This application is a continuation-in-part of application Ser. No. 07/489,647 filed Mar. 6, 1990.

BACKGROUND OF THE INVENTION

The present invention relates to pin connectors and in particular to pin connectors having insulation displacement contacts and a termination cover, securable to the pin connector, either having or adapted to receive a latch/eject lever.

The use of latch/eject levers is known. U.S. Pat. No. 4,761,141 discloses a shroud for positioning over pins in a pin field that can be latchingly secured to pins in the pin field by a latch/eject lever. A shrouded pin header is disclosed in U.S. Pat. No. 4,178,051 capable of being soldered to a printed circuit board and latchingly securing a mating connector in a cavity in the shrouded pin header.

SUMMARY OF THE INVENTION

In accordance with the present invention, a pin connector for insulation displacement termination of conductors of a multiple conductor cable has a housing having insulation displacement contacts secured therein. Each of the insulation displacement contacts has an insulation displacement portion extending beyond a cable receiving face for terminating to conductors of a multiconductor cable. A termination cover securable to the housing is adapted to be pressed toward the cable receiving face to terminate conductors of the cable to respective contacts. The termination cover has a pivotally mounted latch/eject lever secured thereto for latchingly securing a mating connector to the pin connector. The housing has extensions with protrusions receivable in pivotal mounting apertures to secure the termination cover to the housing at the termination position.

DESCRIPTION OF THE PREFERRED EMBODIMENT

Figure 1:
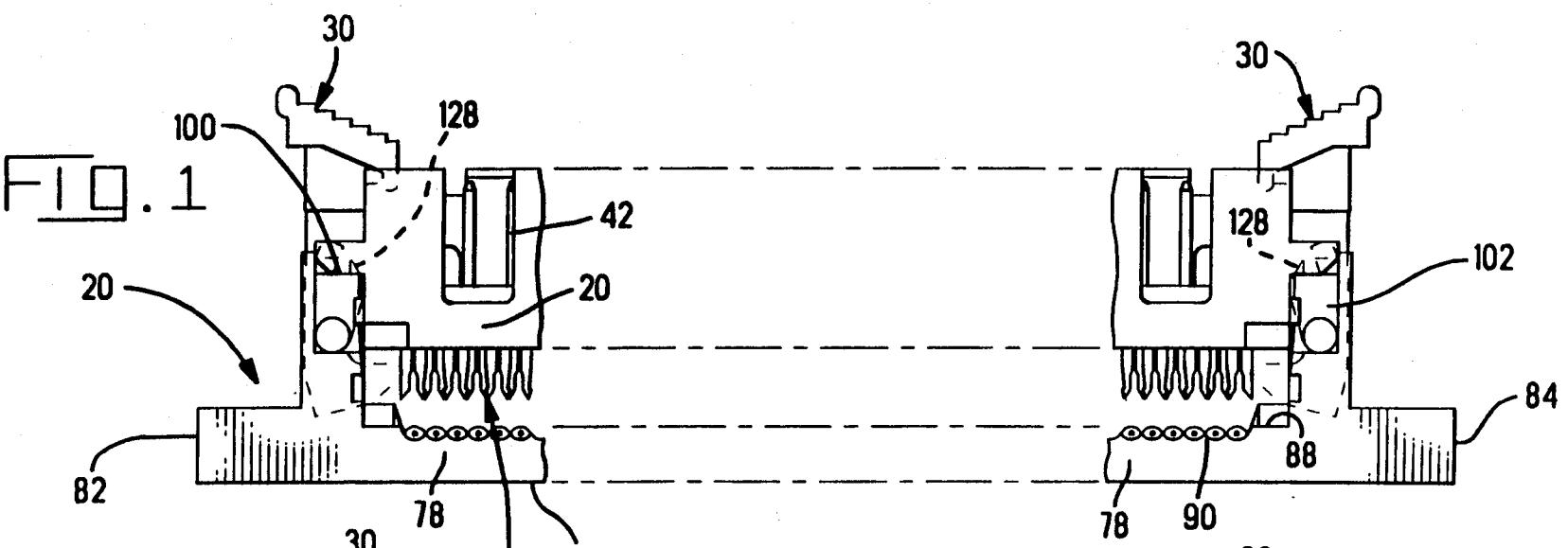
FIG. 1 is a side view of a pin connector with the termination cover in a pretermination position, with a ribbon cable positioned to be terminated therein, in accordance with the present invention.

A pin connector 20 in accordance with the present invention is shown in FIG. 1. Pin connector 20 includes shroud 22 having an array 24 of contacts 26 secured therein and terminating cover 28 having latch/eject levers 30 secured therein, or adapted to have latch/eject levers 30 secured therein.

Shroud 22 has an elongate housing 32 molded of insulative material having a U-shaped cross section. Housing 32 has a base 34 having walls 36 integral with side edges thereof and extending normally to an inside floor 38 of base 34. Walls 36 and floor 38 define cavity 40. Contacts 26 are secured in base 34 with a pin portion 42 extending into cavity 40, protected by walls 38, for mating with receptacle contacts (not shown) in a complementary connector 44 (see FIG. 2), also received in cavity 40. Complementary connector 44 could take many forms, such as part number 746290 manufactured by the assignee. Each contact 26 also has an insulation piercing portion 46 extending beyond a cable receiving face 48 on the opposite side of base 34 from floor 38.

Walls 36 provide protection for pin portions 42 and may have slots 50 formed therein to receive polarization features of complementary connector 44. While a particular polarization feature has been shown, walls 36 may be modified by appropriate molding to accommodate other forms of polarization such as a single slot or military polarization.

Figure 3:
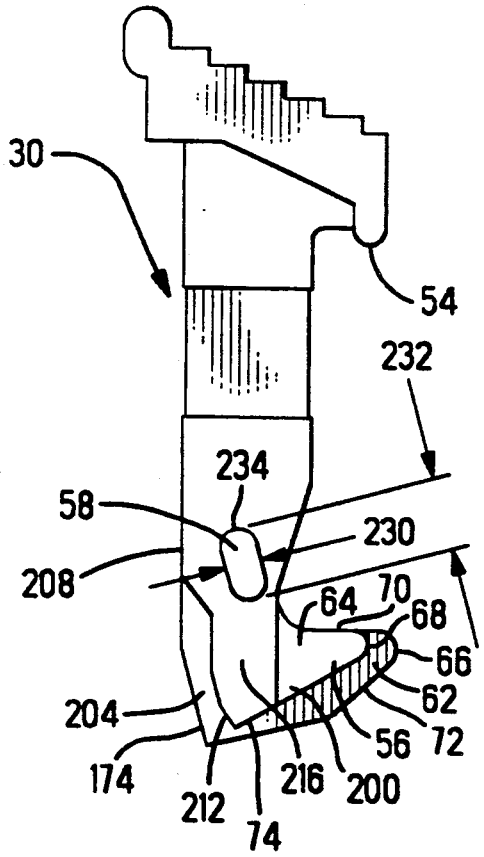
FIG. 3 is a side view of a latch/eject lever.
Figure 4:
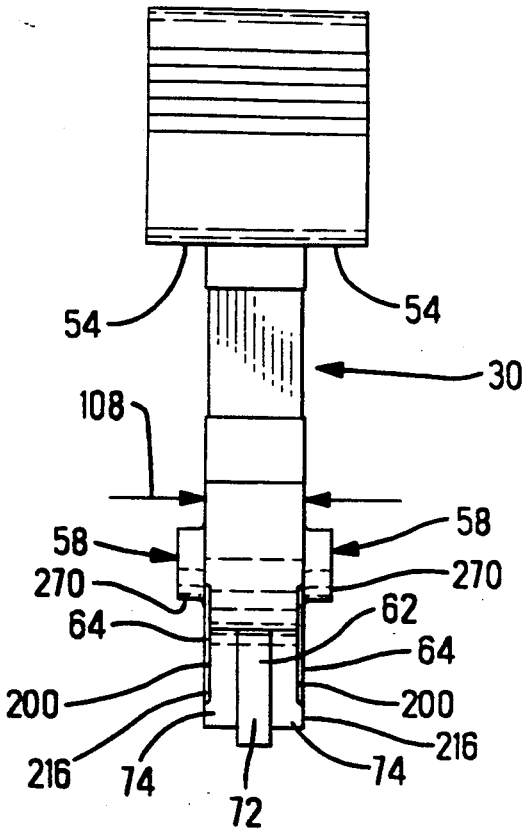
FIG. 4 is an end view of a latch/eject lever.

A latch/eject lever 30 is shown in FIGS. 3 and 4. It is understood that while the latch/eject lever 30 of the preferred embodiment will be described as performing the dual functions of latching complementary connector 44 in a mated position in cavity 40 and ejecting complementary connector 44 from the mated position in cavity 40, these functions may be performed independently. Accomplishing either of these functions independently with the terminating cover described herein is contemplated as within the scope of the invention. Thus, the notation latch/eject lever or lever shall mean either a latch lever, an eject lever or a lever that is capable of performing both functions. Lever 30 has a latching shoulder 54, a foot 56 and an integral pivot shaft 58. Pivot shaft 58 has an elongate shape to facilitate insertion as will be described in more detail below. Foot 56 has central portion 62 that extends beyond side portions 64, with both central portion 62 and side portions 64 forming rounded edges, respectively 66 and 68, as they merge to form the upper surface 70 of foot 64. Central portion 62 and side portions 64 have respective under surfaces 72,74.

Figure 10:
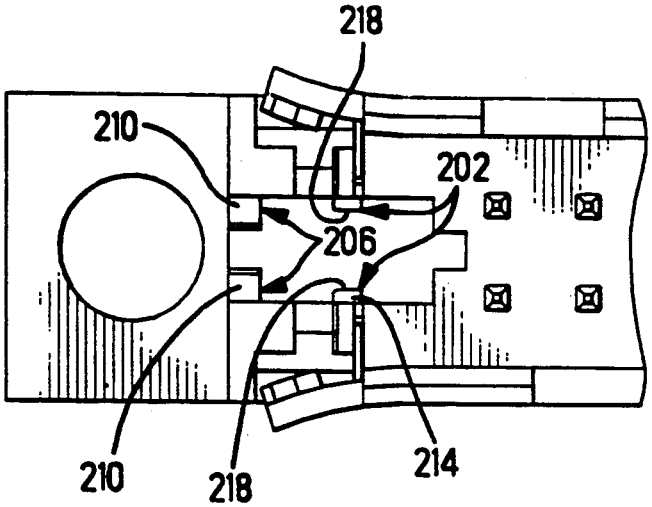
FIG. 10 is a partial top view of the termination cover and pin connector during termination.
Figure 8:
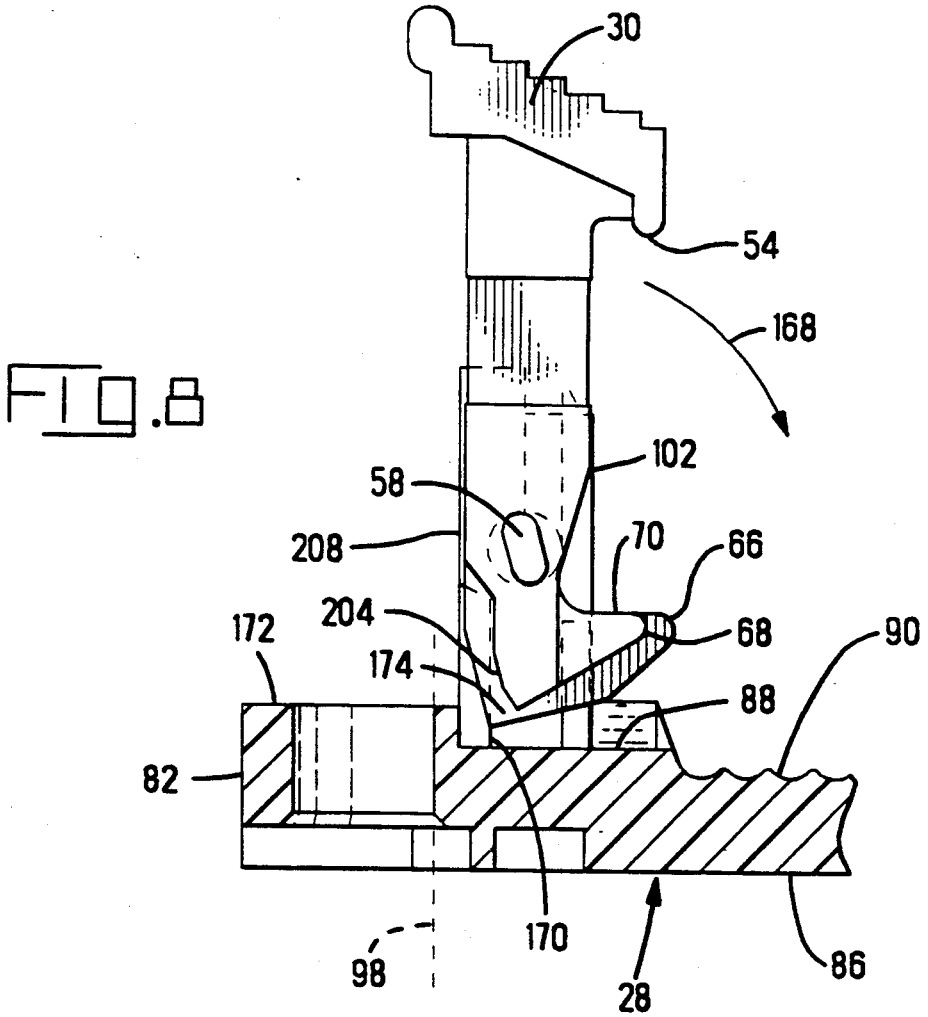
FIG. 8 is a partial side view of the terminating cover showing a clockwise latch/eject lever stop.
Figure 9:
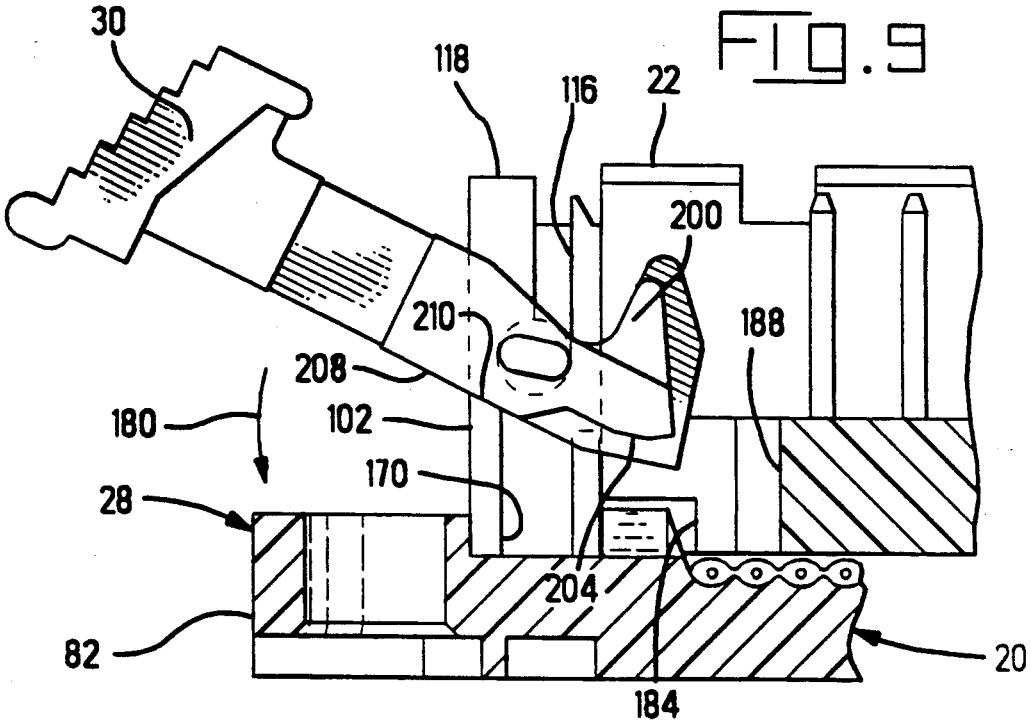
FIG. 9 is a partial side view of the terminating cover and shroud showing a counter clockwise stop.

Each side portion 64 has a forward recess 200 to receive a respective forward rib 202 (see FIGS. 5 and 10) and a rear recess 204 to receive a respective rear rib 206 (see FIG. 10). Ribs 202 and 206 extend toward like ribs on facing surfaces 104. Rear recess 204 defines surface 208 which engages the top surface 210 of a respective rear rib 206 to provide a counterclockwise (as shown in FIGS. 3, 8 and 9) stop for lever 30. This stop is effective even when a shroud 22 is not secured to terminating cover 28.

With lever 30 in the counterclockwise position and surface 208 engaging top surfaces 210, forward ribs 202 are within rear recesses 204 and shoulder surfaces 212 engage the top surfaces 214 of forward ribs 202. This later engagement serves as a detent that secures lever 30 in the counterclockwise position, which in the preferred embodiment is approximately 60 degrees.

With lever 30 in the vertical position, forward ribs 202 are received in respective recesses 200 to hold lever 30 in the vertical position. This provides a vertical detent. Lever 30 can be easily rotated out of the vertical position due to forward ribs 202 being relatively thin.

When lever 30 is between the counterclockwise stop position and the vertical position described above, the outer sidewalls 216 of side portions 64 engage facing surfaces 218 of ribs 202 in an interference fit to maintain lever 30 in the position it is left in.

Figure 7:
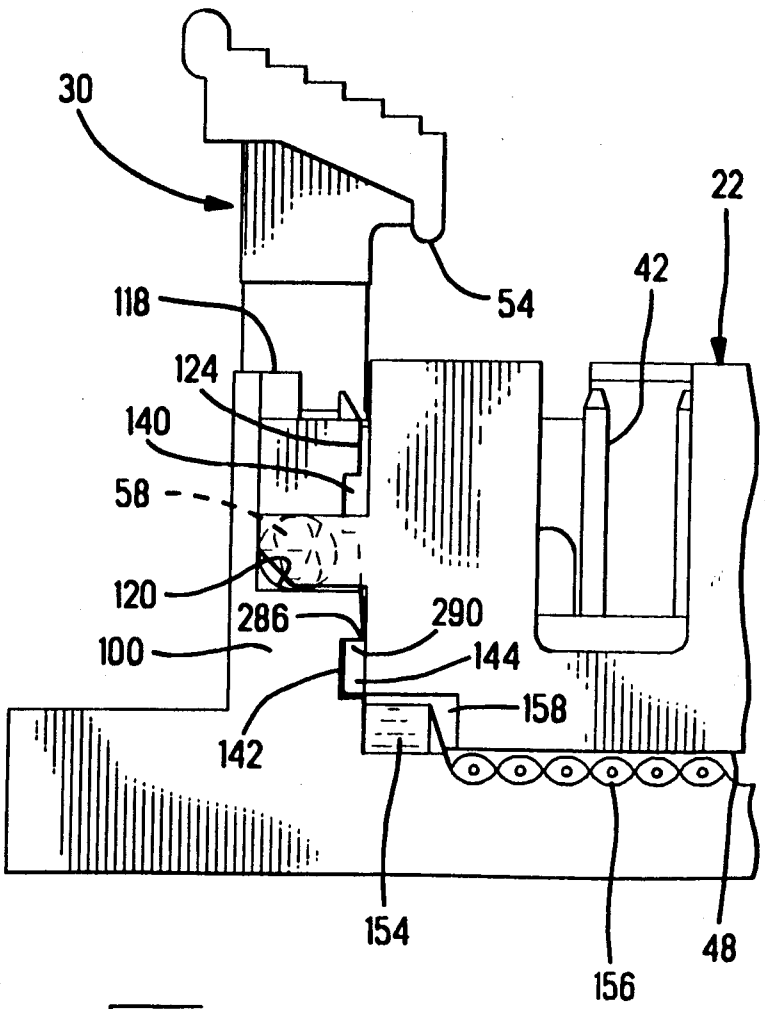
FIG. 7 is an enlarged partial side view of a pin connector showing the termination cover secured in the terminated position, with a cable terminated in the pin connector.
Figure 6:
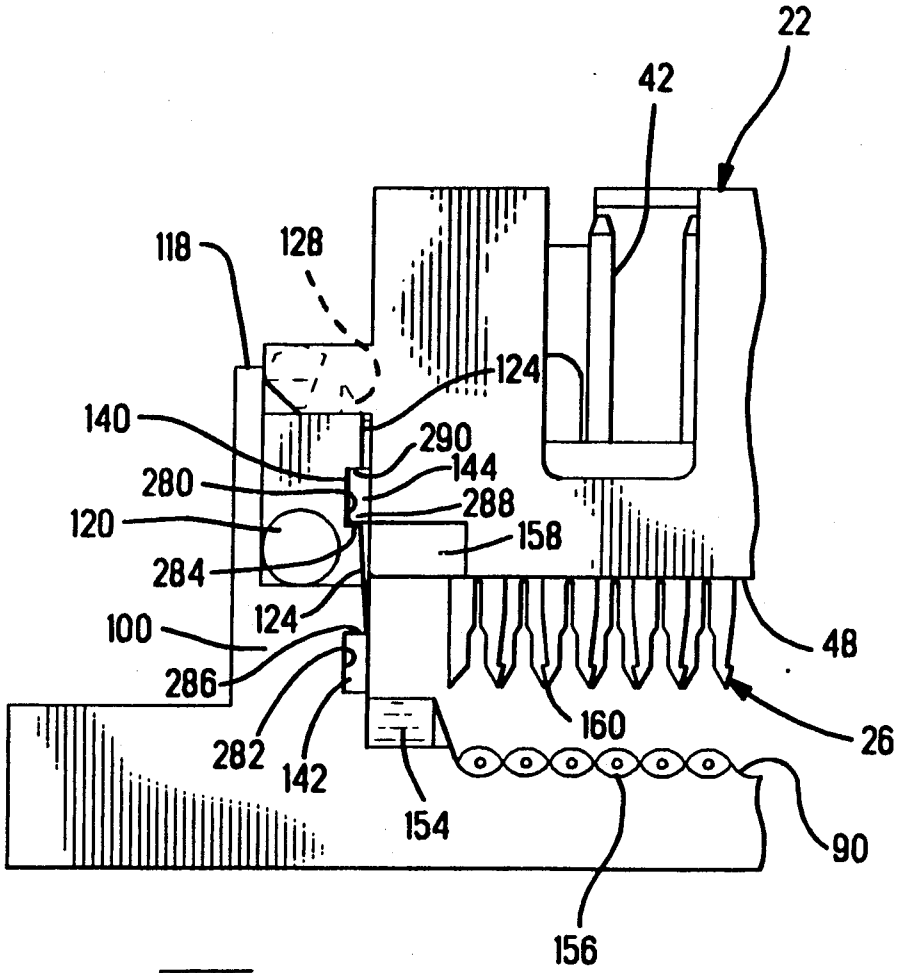
FIG. 6 is an enlarged partial side view of a pin connector showing the termination cover secured in the pretermination position.

Terminating cover 28 is elongate having opposed side walls 78,80, opposed end walls 82,84, outer surface 86 and opposed inner surface 88, a portion of which forms fluted surface 90. Terminating cover 28 has recesses or apertures 92, in accordance with the teaching of U.S. Pat. Nos. 3,820,055, 4,410,229 or 4,781,615, the disclosures of which are hereby incorporated by reference. Apertures 92 receive the leading sections of insulation piercing portions 46. Terminating cover 28 may have flanges 94 for securing pin connector 20 to a circuit board or back panel of a computer. Flanges 94 may have a slot 96 as shown in FIGS. 6-8 or an aperture to receive a bolt or threaded insert as are known in the art. Absent the need for features to anchor pin connector 20 to a circuit board or back panel, flanges 94 may be terminated such as at line 98 in FIG. 8.

Spaced leg means 100,102 extend from inner surface 88 proximate end walls 82,84. In the preferred embodiment, the leg means at each end of terminating cover 28 are identical and leg means at only one end will be described. Leg means 100,102 at one end of terminating cover 28 are spaced from leg means 100,102 at the other end of terminating cover 28 to receive and secure shroud 22 therebetween.

Figure 5:
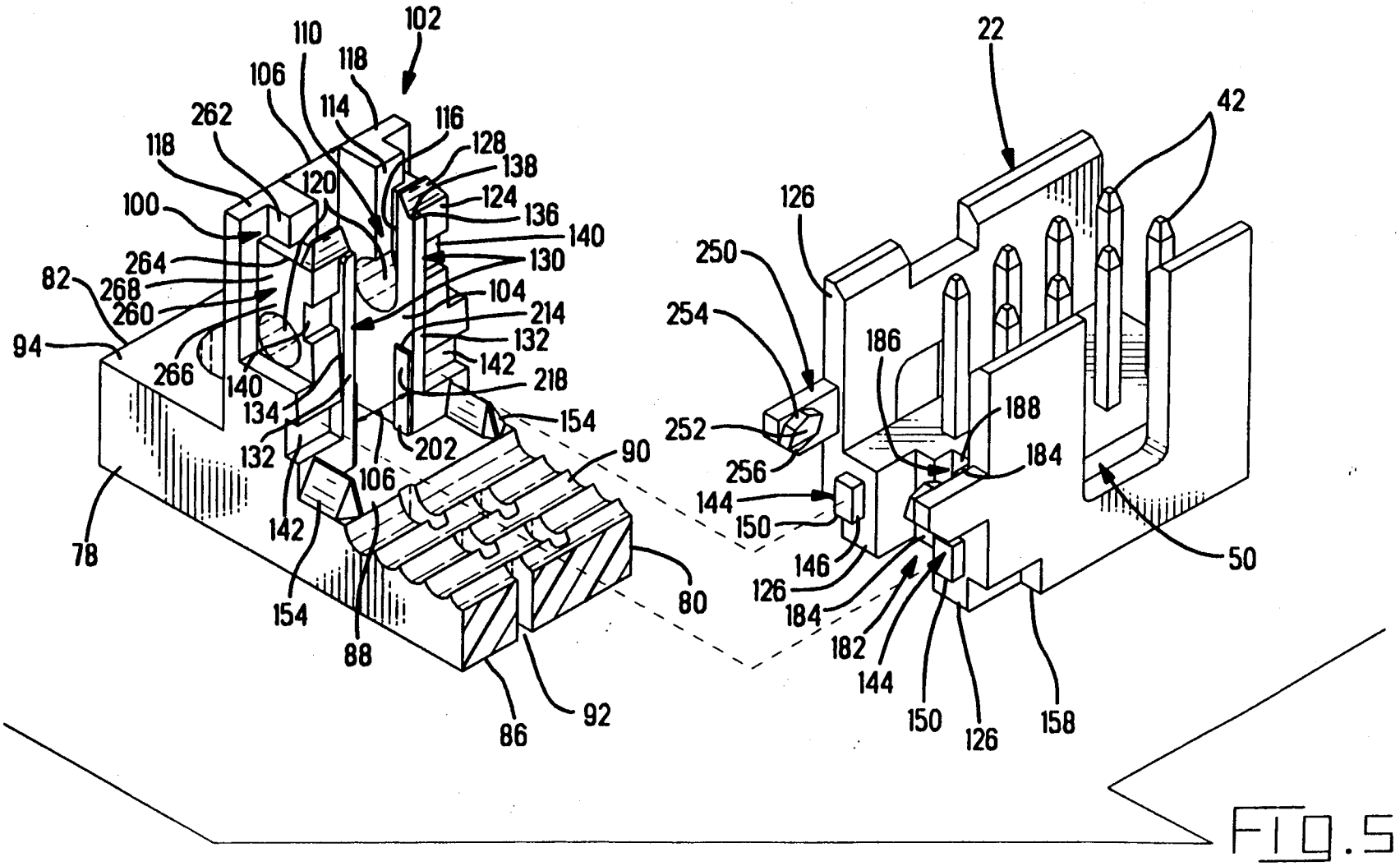
FIG. 5 is a perspective view of the termination cover securing system.

As best seen in FIGS. 5 and 10, facing surfaces 104 of leg means 100,102 are spaced apart a distance 106 that is substantially the thickness 108 (see FIG. 4) of latch/eject lever 30 to receive latch/eject lever 30 therebetween. In the preferred embodiment, leg means 100,102 are mirror images of each other. Leg means 100,102 have opposed channels 110 (see FIG. 5) substantially the width 230 (see FIG. 3) of pivot shaft 58 to receive shaft 58. With lever 30 oriented clockwise from the vertical position, pivot shaft 58 will slide along channel 110 from end 118 to apertures 120 to assemble lever 30 to terminating cover 28. Upon shaft 58 being received in aperture 120 lever 30 can be rotated, typically counterclockwise, to secure lever 30 to terminating cover 28. Lever 30 can be removed by reorienting the lever clockwise from the vertical position and sliding pivot shaft 58 toward end 118. Thus, lever 30 is replaceable. Apertures 120 in leg means 100,102 extend, in the preferred embodiment, are aligned and extend from inside surface 104 through the leg means and open onto opposed outer surfaces 268. Pivot protrusions 270 on shaft 58 are received in apertures 120 from inside surface 104 and extend partially through leg means 100,102. Pivot protrusions 270 on shaft 58 seat in cylindrical apertures or recesses 120 thereby securing latch/eject lever 30 to terminating cover 28 and simultaneously providing a pivot for latch/eject lever 30 upon pivotally securing latch/eject lever 30 to terminating cover 28. The longer dimension 232 of shaft 58 is substantially the diameter of aperture 120, with the curved ends 234 riding within aperture 120. Leg means 100,102 thus provide structure on the terminating cover adapted to have secured thereto at least one latch/eject lever.

Each of leg means 100,102 have an inside end surface 124 that faces the inside end surface of spaced leg means at the other end of terminating cover 28. Surfaces 124 on leg means 100,102 at the two ends of terminating cover 28 are spaced substantially as the end wall surfaces 126 at the two ends of housing 32 of shroud 22. As stated above, shroud 22 is received between inside end surfaces 124 of leg means 100,102 at the ends of the terminating cover. A portion of end walls 126 of shroud 22 slidingly engage surfaces 124 as shroud 22 is positioned between leg means at the ends of terminating cover 28, as best seen in the side views shown in FIGS. 2 and 3. Inside end surfaces 124 are tapered at 128 where they would otherwise intersect ends 118 of leg means 100,102. Tapers 128 assist in laterally positioning shroud 22 between the leg means at the two ends of terminating cover 28 as the shroud is positioned relative to terminating cover 28.

Guide rails 130 are raised above surfaces 124 defining surface 132 and extend substantially from taper 128 to inner surface 88. In the preferred embodiment, the facing surfaces of guide rails 130 are contiguous with and are merely an extension of facing surfaces 104. On the opposite side of guide rails 130 from facing surfaces 104, guide rails 130 form protrusion engaging surfaces 134 which face outwardly toward side walls 78 and 80. Surfaces 134 are chamfered 136 at end 138 to assist in side-to-side positioning of shroud 22 relative to terminating cover 28. Each of leg means 100,102 has a first transverse slot 140 spaced a first predetermined distance from inner surface 88 and recessed from surface 124 and a second transverse slot 142 spaced a second predetermined distance from inner surface 88, between the first transverse slot 140 and inner surface 88. The second transverse slot 142 is also recessed from surface 124.

As best seen in FIGS. 5, 6 and 7, vertical surfaces 280 and 282 in slots 140 and 142 are substantially coplanar. Surfaces 124 are angled toward the leg means at the other end of terminating cover 28 from the distal end of leg means 100,102 toward inner surface 88. This facilitates shroud 22 being moved from the pretermination position to the terminated position in that shoulder 284 at the bottom of slot 140 between vertical surface 280 and surface 124 is shortened due to surface 12 being angled thus facilitating protrusion 144 riding out of slot 140 and over shoulder 284. Concomitantly, shoulder 286 at the top of slot 142 between vertical surface 282 and surface 124 is longer than shoulder 284 enhancing the retention of protrusion 144 in slot 142 and in turn enhancing securing the shroud to the terminating cover. While the lower corner 288 of protrusion 144 may be slightly deformed in riding over corner 284 as the terminating cover is moved from a pretermination position to the terminated position, upper corner 290 is not deformed in this process.

Guide rails 130 cooperate with protrusions 144 upstanding from end walls 126 to provide stability as shroud 22 is positioned on terminating cover 28. Side surface 146 of a protrusion 144 slides along a corresponding protrusion engaging surface 134 of a guide rail 130 while end surface 148 slides along a corresponding surface 124 of a corresponding guide rail. The corner edge 150 of a protrusion 144 may be rounded to facilitate movement.

Each end surface 124 has a secondary latching protrusion 250 extending therefrom toward a respective leg means 100,102. Each latching protrusion 250 has a transverse extending latch member 252 sized to be received in aperture 120. Latch member 252 defines an upwardly facing shoulder 254 and downwardly sloped taper 256.

Protrusions 250 are received in notches 260 with latch members 252 received in further notches 262 when terminating cover 28 is preassembled onto shroud 22 in the pretermination position as shown in FIGS. 1 and 6. As the terminating cover is moved to the termination position, taper 256 rides over edge 264 and protrusions 250 flex outwardly as shown in FIG. 10. Furthermore, leg means 100,102 may flex outwardly away from leg means at the other end of cover 28, with cover 28 bowing therebetween. Latch member 252 slides along surface 266 until latch members 252 are aligned with aperture 120, whereupon protrusions 250 resile inwardly as latch members 252 are received in apertures 120, simultaneously cover 28 also resiles. Protrusions 144 being received in slots 142 provides a secondary lock securing the terminating cover 28 to shroud 22. While aperture 120 is conveniently used for both a pivot 58 and a latch member 252, separate recesses for the pivot and secondary latch would function equally as well.

Cable guides 154 extend from inner surface 88 along leg means 100,102 to guide cable 156 during insertion into pin connector 20 as well as during positioning cable 156 in fluted surface 90. Guides 154 are received in recesses 158 in housing 32 during termination of cable 156.

Terminating cover 28 is preassembled onto shroud 22 in a pretermination position for ease of threading a ribbon cable between insulation piercing portions 46 and inner surface 90. In this manner, pin connector 22 is capable of being employed in daisy chain applications.

Prior to preassembling shroud 22 to terminating cover 28, shroud 22 is positioned above inner surface 88 between leg means 100,102 at the ends of terminating cover 28. As shroud 22 is moved toward inner surface 88 for preassembling to terminating cover 28, end walls 126 cooperate with tapers 128 to position shroud 22 from end-to-end relative to terminating cover 28, and chamfers 136 cooperate With protrusions 144 to position shroud 22 from side-to-side. The rounded corner edge 150 on protrusions 144, coupled with taper 128 assist in causing leg means 100,102 to resiliently deflect toward end walls 82,84 and may cause terminating cover to bow slightly such that end surfaces 148 of protrusions 144 are received between surfaces 124 on leg means 88 at the two ends of terminating cover 28 and side surfaces 146 of protrusions 144 slidingly engage and slide along protrusion engaging surfaces 134 to guide the cable receiving face 48 toward and substantially parallel to inner surface 88.

Figure 2:
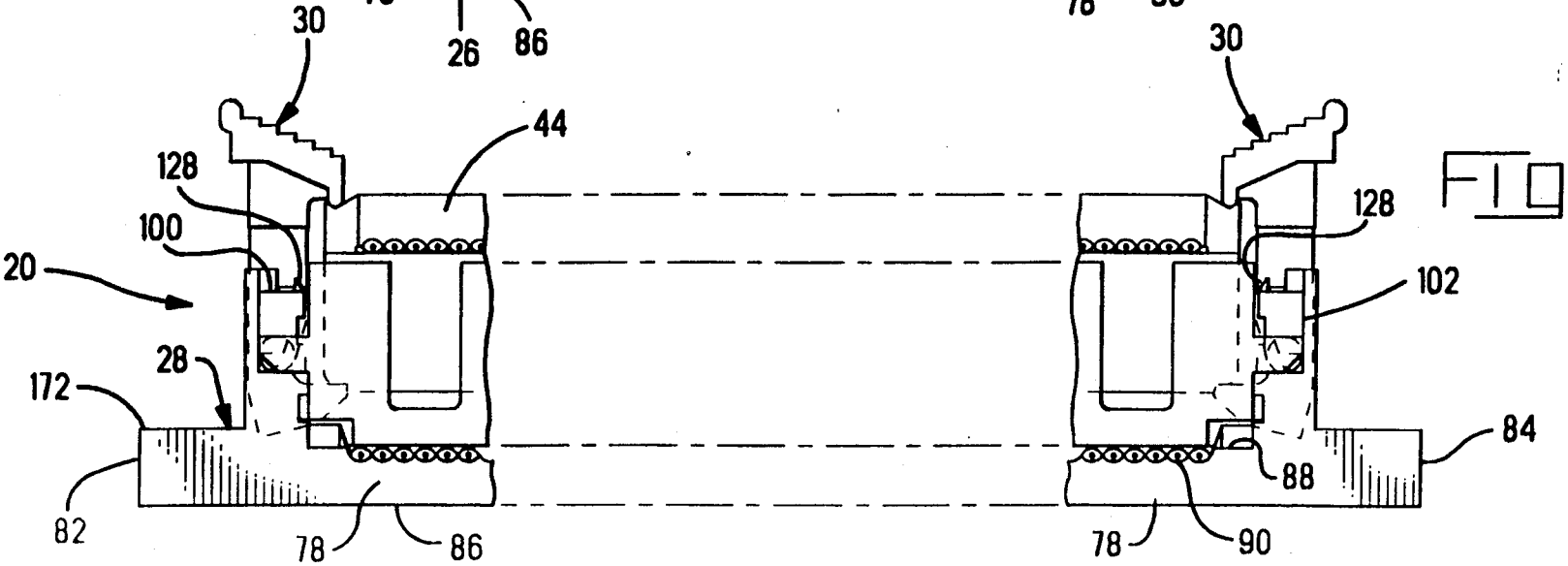
FIG. 2 is a side view of the pin connector of FIG. 1 with the termination cover in a terminated position.

As shroud 22 is moved toward inner surface 88, protrusions 144 are received in respective first transverse slots 140 as shown in FIGS. 1 and 2. Upon protrusions 144 seating in first transverse slots 140, leg means 100,102 resile inwardly to an unbiased position and terminating cover 28 also resiles to secure terminating cover 28 and shroud 22 in a pretermination position.

As shown in an enlarged view in FIG. 6, in the pretermination position there is sufficient space between ends 160 of insulation piercing portions 46 and the inner surface 88, specifically fluted surface 90, for threading a ribbon cable 156 and positioning the cable for termination in pin connector 20. At this stage, latch/eject levers 30 may or may not be positioned pivotally secured on terminating cover 28.

To effect termination of cable 156 in pin connector 20, shroud 22 or terminating cover 28 are moved toward the other to terminate individual conductors 162 to respective ones of the insulation piercing portions 46 of contacts 26. Typically, outer surface 86 will be positioned against a surface and a tool (not shown) is positioned in cavity 40 to extend over pin portions 42 and press on floor 38 to cause shroud 22 to move from a pretermination position to a termination position and in the process effect termination of conductors of the cable to insulation piercing portions of the contacts in a known manner.

In moving from the pretermination position, leg means 100,102 again resiliently deflect toward end walls 82,84 and terminating cover 28 may bow slightly such that end surfaces 148 of protrusions 144 ride out of first transverse slots 140, facilitated by rounded corner edge 150, and slidingly engage surfaces 124 as slide surface 146 slidingly engages protrusion engaging surface 134 to guide the cable receiving face 48 toward and substantially parallel to inner surface 88 until protrusions 144 are received in respective second transverse slots 142 as shown in FIGS. 3 and 8. Upon protrusions 144 seating in second transverse slot 142, leg means 100,102 resile inwardly to an unbiased position and terminating cover 28 also resiles to secure terminating cover 28 and shroud 22 in a terminated position. In the terminated position as shown in FIGS. 1 and 7, cable 156 is secured between cable receiving face 48 and inner surface 88, specifically inner surface 90, and latch members 252 are recessed in respective apertures 120.

Terminating cover 28 can be terminated to a cable as described above with or without latch/eject levers 30 secured therein. With latch/eject levers 30 secured in terminating cover 28, the latch/eject levers do not interfere with the tooling or the termination process. In the event that termination is effected without latch/eject levers 30 secured in terminating cover 28, the levers can be installed subsequent to termination.

As best seen in FIGS. 9 and 10, stops are provided to prevent undesired clockwise or counter clockwise movement of latch/eject levers 30. With reference to FIG. 9, clockwise movement of latch/eject lever 30, as indicated by arrow 168, beyond a vertical position is prevented by providing a stop shoulder 170 defined by forward vertical surface of 206. Surface 204 engages surface 206 preventing further clockwise movement. This stop is effective whether or not shroud 22 is secured to terminating cover 28.

With reference to FIG. 9, with termination cover 28 secured in the termination position relative to shroud 22, further counter clockwise movement of latch/eject lever 30, from the position shown and as indicated by arrow 180, is prevented. Foot 56 is received in recess 182 (see FIG. 6) with edges 68 of side portions 64 clearing surfaces 184 and edge 66 of central portion 62 passing through further recess 186, clearing surface 188 in their respective arcuate paths as latch/eject lever 30 pivots about shaft 58. Surface 210 provides a counter clockwise stop by engaging surface 208 of latch/eject lever 30. The counter clockwise stop, as shown in FIG. 9, provides a limit to the arcuate counter clockwise travel of latch/eject lever 30.

I claim:

1. A connector for insulation displacement termination of conductors of a multiple conductor cable, comprising:

an elongate termination cover movable to a termination position, said termination cover defining an endwall and an inner surface, said termination cover having a pair of spaced legs extending from the inner surface proximate the endwall, said legs having facing surfaces and opposed outer surfaces, said legs having aligned apertures extending therethrough from a facing surface to a respective outer surface;

a latch/eject lever having pivot protrusions thereon, said latch/eject lever pivotally secured to said termination cover between the facing surfaces of said legs with the pivot protrusions received in respective ones of said aligned apertures; and an elongate housing defining a wall and having insulation displacement contacts secured therein, each of said insulation displacement contacts having an insulation displacement portion extending beyond a cable receiving face for termination to a conductor of the multiple conductor cable, a pair of spaced latching protrusions extending from said wall, each of said protrusions having a transverse extension defining a latching shoulder facing away from said cable receiving face, said latching protrusions spaced to receive said pair of spaced legs therebetween, said latching shoulder on each latching protrusion extending toward the outer latching protrusion and adapted to be received in a respective one of said aligned apertures of said leg means when said termination cover is in said termination position.

2. A connector as recited in claim 1, further comprising a rib on a facing surface of at least one of said legs, said rib extending outwardly from said at least one legs toward the other of said legs, said rib adapted to provide an interference fit between the rib and the latch/eject lever secured in said termination cover.

3. A connector as recited in claim 2, wherein the latch/eject lever defines a foot portion that pivots between said spaced legs, said foot portion having a central region, said foot portion further comprising a forward recess such that when the latch/eject lever pivots until the central region passes said rib and said rib is received in the forward recess, the forward recess cooperates with the rib to define a detent that maintains the pivotal orientation of the latch/eject lever.

4. A connector as recited in claim 2, wherein the latch/eject lever defines a foot portion, that pivots between said spaced legs, said foot portion having a central region, said foot portion further comprising a rear recess such that when the latch/eject lever pivots until the central region passes said rib and said rib is received in the rear recess, the rear recess cooperates with the rib to define a detent that maintains the pivotal orientation of the latch/eject lever.

5. A connector as recited in claim 1, further comprising first securing means on said housing and termination cover to secure the termination cover to the housing in a pretermination position with the inner surface of the terminating cover spaced from the cable receiving face.

6. A connector as recited in claim 5, wherein the first securing means on the housing comprises a first rib extending from the wall, said first rib spaced a first predetermined rib distance from said cable receiving face and the first securing means on the terminating cover comprises a first recess, said first recess spaced a first predetermined recess distance from the inside surface of the termination cover.

7. A connector as recited in claim 5, further comprising second securing means on said housing and termination cover to secure the termination cover to the housing in the termination position.

8. A connector as recited in claim 7, wherein the second securing means on the housing comprises a second rib extending from the wall, said second rib spaced a second predetermined rib distance from said cable receiving face, said second predetermined rib distance being less than said first predetermined rib distance, and the second securing means on the terminating cover comprises a second recess, said second recess spaced a second predetermined recess distance from the inside surface of the terminating cover, said second predetermined recess distance being less than said first predetermined recess distance, whereby the termination cover can be secured to the housing at a pretermination position then moved toward the cable receiving face to terminate conductors, the termination cover and housing being secured in the termination position by both the second securing means as well as the shoulder of the latching protrusions received in said apertures.

9. A connector as recited in claim 8, further comprising a rib on a facing surface of at least one of said leg means, said rib extending outwardly from said at least one leg means toward the other of said leg means, said rib adapted to provide an interference fit between the rib and a latch/eject lever secured in said termination cover.

10. A connector as recited in claim 8, wherein said leg means each have a recess to receive the transverse extension when the termination cover and the housing are secured in the pretermination position.

11. A connector for insulation displacement termination of conductors of a multiple conductor cable, comprising:

an elongate termination cover movable from a pretermination position to termination position, said termination cover defining an endwall and an inner surface, said termination cover having a pair of spaced leg means extending from the inner surface proximate the endwall, said leg means having aligned apertures therethrough adapted to pivotally secure a latch/eject lever between facing surfaces of said leg means; and an elongate housing defining a wall and having insulation displacement contacts secured therein, each of said insulation displacement contacts having an insulation displacement portion extending beyond a cable receiving face for termination to a conductor of the multiple conductor cable, a pair of spaced latching protrusions extending from said wall, each of said protrusions having a transverse extension defining a latching shoulder facing away from said cable receiving face, said latching protrusions spaced to receive said pair of spaced leg means therebetween, said latching shoulder on each latching protrusion extending toward the other latching protrusion and adapted to be received in a respective one of said aligned apertures of said leg means when said termination cover is in said termination position.

12. A connector as recited in claim 9, wherein the latch/eject lever defines a foot portion, that pivots between said spaced leg means, said foot portion having a central region, said foot portion further comprising a forward recess such that when the latch/eject lever pivots until the central region passes said rib and said rib is received in the forward recess, the forward recess cooperates with the rib to define a detent that maintains the pivotal orientation of the latch/eject lever.

13. A connector as recited in claim 9, wherein the latch/eject lever defines a foot portion, that pivots between said spaced leg means, said foot portion having a central region, said foot portion further comprising a rear recess such that when the latch/eject lever pivots until the central region passes said rib and said rib is received in the rear recess, the rear recess cooperates with the rib to define a detent that maintains the pivotal orientation of the latch/eject lever.

14. A connector as recited in claim 8 further comprising a latch/eject lever having pivot protrusions thereon, said latch/eject lever pivotally secured to said termination cover between the facing surfaces of said leg means with the pivot protrusions received in respective ones of said aligned apertures.

15. A connector as recited in claim 8, further comprising first securing means on said housing and termination cover to secure the termination cover to the housing in the pretermination position with the inner surface of the terminating cover spaced from the cable receiving face.

16. A connector as recited in claim 15, wherein the first securing means on the housing comprises a first rib extending from the wall, said first rib spaced a first predetermined rib distance from said cable receiving face and the first securing means on the terminating cover comprises a first recess, said first recess spaced a first predetermined recess distance from the inside surface of the termination cover.

17. A connector as recited in claim 15, further comprising second securing means on said housing and termination cover to secure the termination cover to the housing in the termination position.

18. A connector as recited in claim 17, wherein the second securing means on the housing comprises a second rib extending from the wall, said second rib spaced a second predetermined rib distance from said cable receiving face, said second predetermined rib distance being less than said first predetermined rib distance, and the second securing means on the terminating cover comprises a second recess, said second recess spaced a second predetermined recess distance from the inside surface of the terminating cover, said second predetermined recess distance being less than said first predetermined recess distance, whereby the termination cover can be secured to the housing at a pretermination position then moved toward the cable receiving face to terminate conductors, the termination cover and housing being secured in the termination position by both the second securing means as well as the shoulder of the latching protrusions received in said apertures.

19. A connector for insulation displacement termination of conductors of a multiple conductor cable, comprising:

a termination cover, said termination cover having leg means extending from an inner surface, said leg means adapted to have a latch/eject lever pivotally mounted in aperture means therein; and a housing having insulation displacement contacts secured therein, each of said insulation displacement contacts having an insulation displacement portion extending beyond a cable receiving face for termination to a conductor of the multiple conductor cable, said housing having a latching protrusion receivable in said aperture means to secure said housing and said termination cover.

20. A connector as recited in claim 19, wherein the termination cover is adapted to be moved toward the cable receiving face to a termination position where conductors of the multiple conductor cable are terminated on the insulation displacement contacts and wherein said latching protrusion is received in said aperture means.

* * * * *

UNITED STATES PATENT AND TRADEMARK OFFICE

CERTIFICATE OF CORRECTION

PATENT NO. : 5,021,004

DATED : June 4, 1991

INVENTOR(S) : Francis M. Heiney

It is certified that error appears in the above-identified patent and that said Letters Patent is hereby corrected as shown below:

In Claim 1, column 7, line 23, after "cable", please insert --said housing having--.

In Claim 1, column 7, line 30, please replace "outer" with "other".

In Claim 2, column 7, line 37, please replace "legs" with "leg".

Signed and Sealed this

Twenty-fifth Day of May, 1993

Michael K. Kirk

MICHAEL K. KIRK

*Acting Commissioner of Patents and Trademarks*

*Attest:*

*Attesting Officer*